US009806466B2

(12) United States Patent
Liao

(10) Patent No.: US 9,806,466 B2
(45) Date of Patent: Oct. 31, 2017

(54) ELECTRICAL CONNECTOR HAVING CONTACT WAFERS WITH A STEP STRUCTURE

(71) Applicant: FOXCONN INTERCONNECT TECHNOLOGY LIMITED, Grand Cayman (KY)

(72) Inventor: Fang-Jwu Liao, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/222,981

(22) Filed: Jul. 29, 2016

(65) Prior Publication Data

US 2017/0033509 A1 Feb. 2, 2017

(30) Foreign Application Priority Data

Jul. 31, 2015 (CN) ..... 2015 2 0567826 U

(51) Int. Cl.

| | |
|---|---|
| ***H01R 13/648*** | (2006.01) |
| ***H01R 13/6586*** | (2011.01) |
| *H01R 13/518* | (2006.01) |
| *H01R 4/02* | (2006.01) |
| *H01R 12/72* | (2011.01) |
| *H01R 24/58* | (2011.01) |

(Continued)

(52) U.S. Cl.

CPC ..... *H01R 13/6586* (2013.01); *H01R 4/023* (2013.01); *H01R 12/721* (2013.01); *H01R 13/518* (2013.01); *H01R 24/58* (2013.01); *H01R 24/60* (2013.01); *H01R 2107/00* (2013.01)

(58) Field of Classification Search

CPC .. H01R 13/514; H01R 13/645; H01R 13/658; H01R 13/6581; H01R 13/6585; H01R 13/6586; H01R 13/6596

USPC ..... 439/607.05, 634, 636, 101

See application file for complete search history.

(56) References Cited

U.S. PATENT DOCUMENTS 5,522,737 A * 6/1996 Brunker ..... H01R 13/6474 439/60
6,099,328 A 8/2000 Nelson et al.
6,939,174 B2 9/2005 Wu (Continued)

FOREIGN PATENT DOCUMENTS

CN CN201708387 1/2011

*Primary Examiner* — Chandrika Prasad

(74) *Attorney, Agent, or Firm* — Wei Te Chung; Ming Chieh Chang

(57) ABSTRACT

An electrical connector includes a metal shell defining a receiving cavity along a front-to-back direction and a number of contact wafers retained in the receiving cavity and assembled together along a transverse direction perpendicular to the front-to-back direction. The contact wafers define a mating cavity along the transverse direction. Each of the contact wafers includes an insulative housing and a number of terminals. The insulative housing includes a main body portion and a pair of extending portions extending forwardly therefrom. The pair of extending portions form an insertion opening along the front-to-back direction. The main body portion is thicker than the extending portions along the transverse direction. Each of terminals has a contacting section extending forwardly from the main body portion and spaced from the extending portion along the transverse direction.

15 Claims, 5 Drawing Sheets

(51) Int. Cl.
*H01R 24/60* (2011.01)
*H01R 107/00* (2006.01)

(56) References Cited

U.S. PATENT DOCUMENTS

| | | | | |
|---|---|---|---|---|
| 2004/0224559 | A1* | 11/2004 | Nelson | H01R 13/514 439/607.05 |
| 2006/0281366 | A1* | 12/2006 | Chen | H01R 4/2425 439/541.5 |
| 2013/0337667 | A1* | 12/2013 | Szczesny | H01R 4/04 439/92 |
| 2014/0148054 | A1* | 5/2014 | Annis | H01R 13/518 439/607.05 |
| 2016/0315420 | A1* | 10/2016 | Horning | H01R 13/6586 |
| 2017/0033482 | A1* | 2/2017 | Liao | H01R 12/75 |

* cited by examiner

ELECTRICAL CONNECTOR HAVING CONTACT WAFERS WITH A STEP STRUCTURE

BACKGROUND OF THE INVENTION

1. Field of the Invention

The present invention relates to an electrical connector, more particularly to an electrical connector adapted for electrically connecting with a Central Processing Unit.

2. Description of Related Art

China Patent No. 201708387 issued on Jan. 12, 2011, discloses an electrical connector including an insulative housing, a plurality of terminals retained in the insulative housing, and a metal shell surrounding the insulative housing. The insulative housing includes a mating cavity to receive a complementary connector. Each terminal has a contacting portion extending into the mating cavity. The insulative housing is formed with one piece so that it can not change its length when necessary.

An improved electrical connector assembly with a changeable length is desired.

BRIEF SUMMARY OF THE INVENTION

Accordingly, an object of the present invention is to provide an electrical connector comprising a metal shell defining a receiving cavity extending along a front-to-back direction and a plurality of contact wafers retained in the receiving cavity and assembled together along a transverse direction perpendicular to the front-to-back diction. The contact wafers define a mating cavity along the transverse direction. Each of the contact wafers comprises an insulative housing comprising a main body portion and a pair of extending portions extending forwardly therefrom. A plurality of terminals are retained in the insulative housing. The pair of extending portions form an insertion opening along the front-to-back direction. The main body portion is thicker than the extending portions along the transverse direction. Each of the terminals has a contacting section extending forwardly from the main body portion and spaced from the extending portion along the transverse direction to leave a free space for the contacting sections' activity. The quantity of the contact wafers is changeable when necessary so as to make the electrical connector suitable for different complementary connectors.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
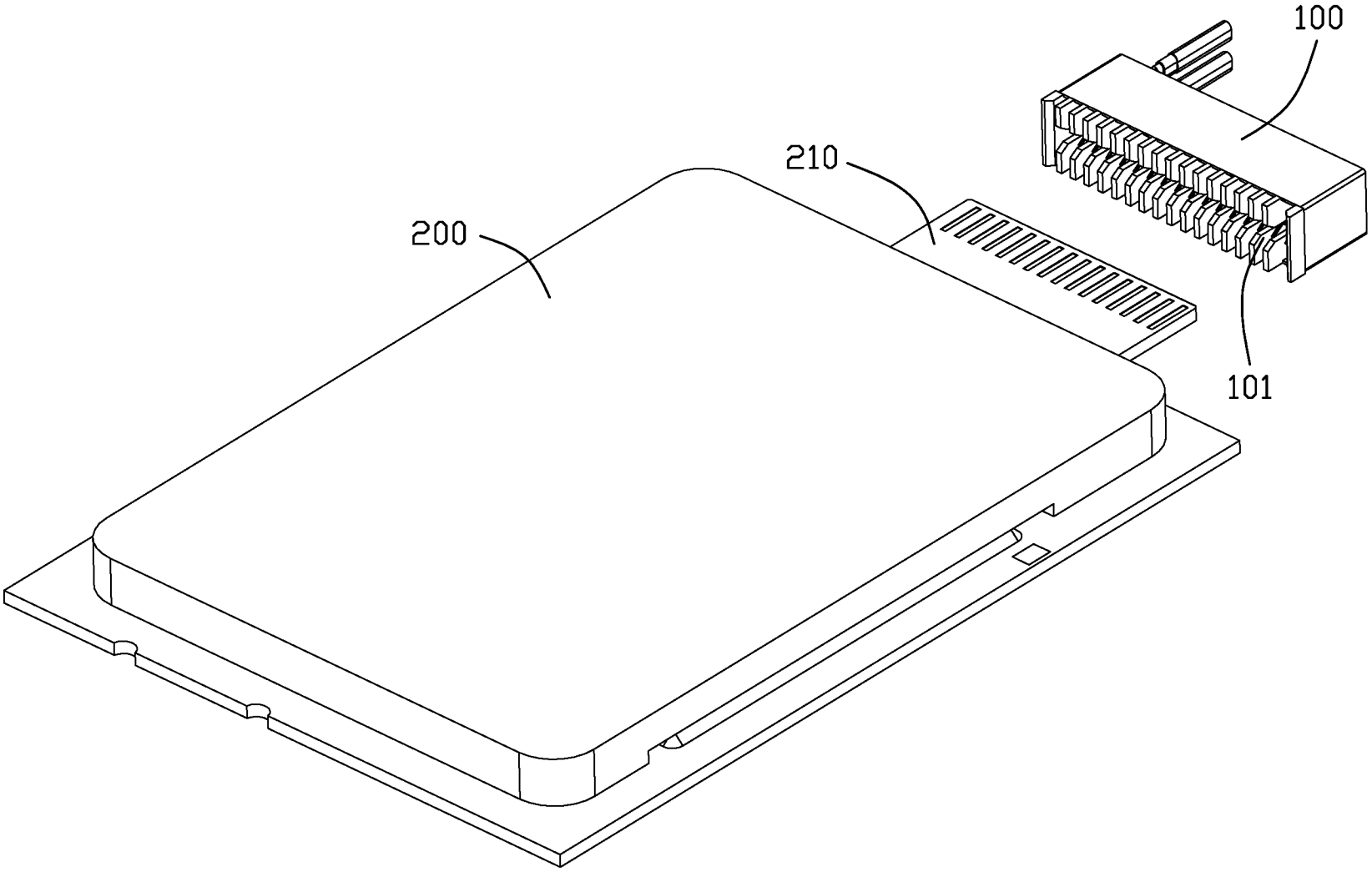
FIG. 1 is a perspective view of an electrical connector and a Central Processing Unit of the present invention.
Figure 2:
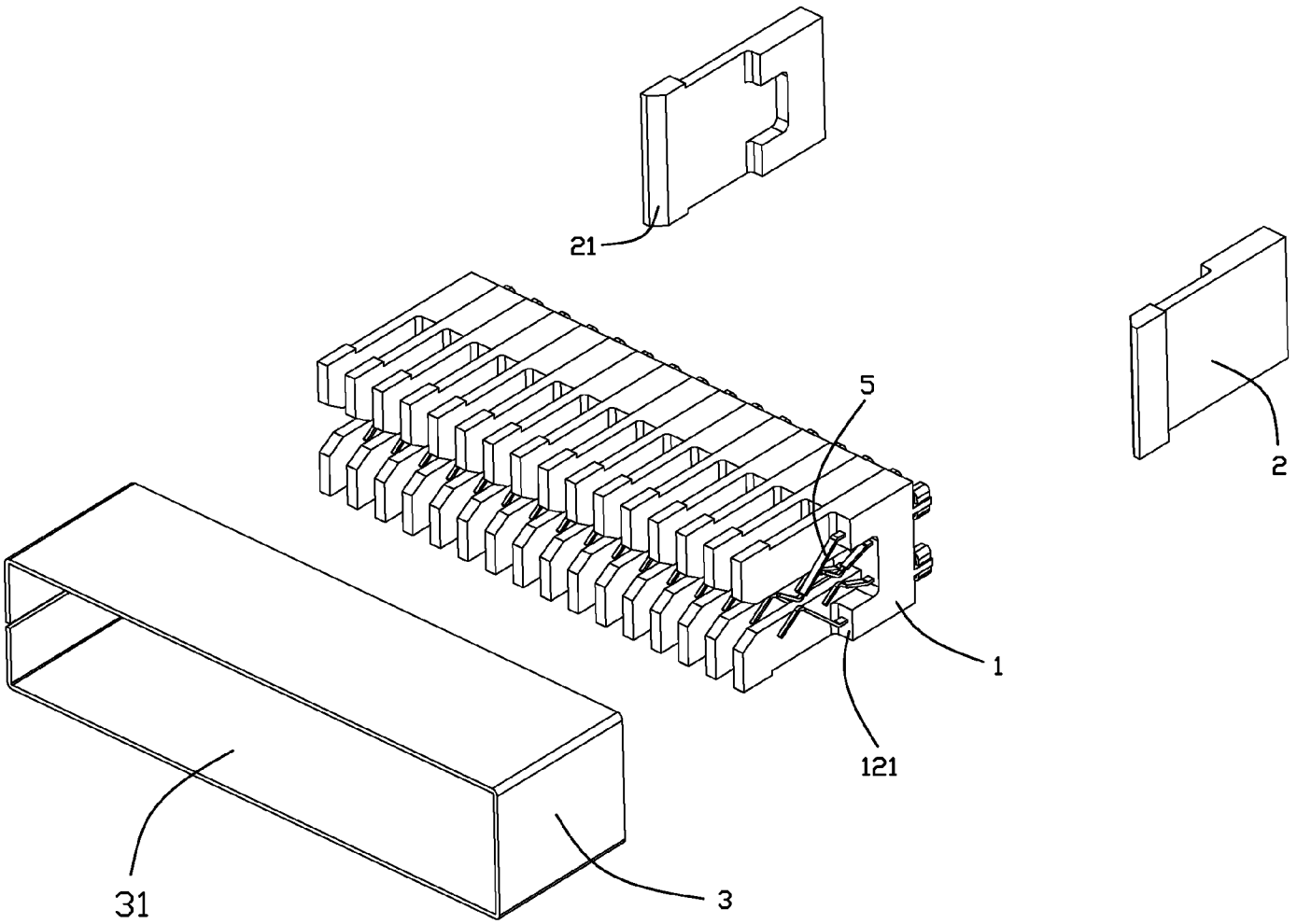
FIG. 2 is an exploded view of the electrical connector shown in FIG. 1.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Referring to FIGS. 1 to 5, an electrical connector assembly 100 is used to electrically connect with a card edge 210 of a Central Processing Unit 200. The electrical connector 100 includes a metal shell 3 defining a receiving cavity 31 extending along a front-to-back direction, a plurality of contact wafers 1 retained in the receiving cavity 31 and assembled together along a transverse direction, two insulative plates 2 assembled at two opposite sides of the contact wafers 1. The quantity of said contact wafers 1 is changeable when necessary. The contact wafers 1 define a mating cavity 101 along the transverse direction. Each of the contact wafers 1 includes an insulative housing 11, a plurality of terminals 5 retained thereto and a shielding plate 4 retained at a lateral side of the insulative housing 11. The terminals 5 are retained to the insulative housing 11 by an insert-molding process.

Figure 3:
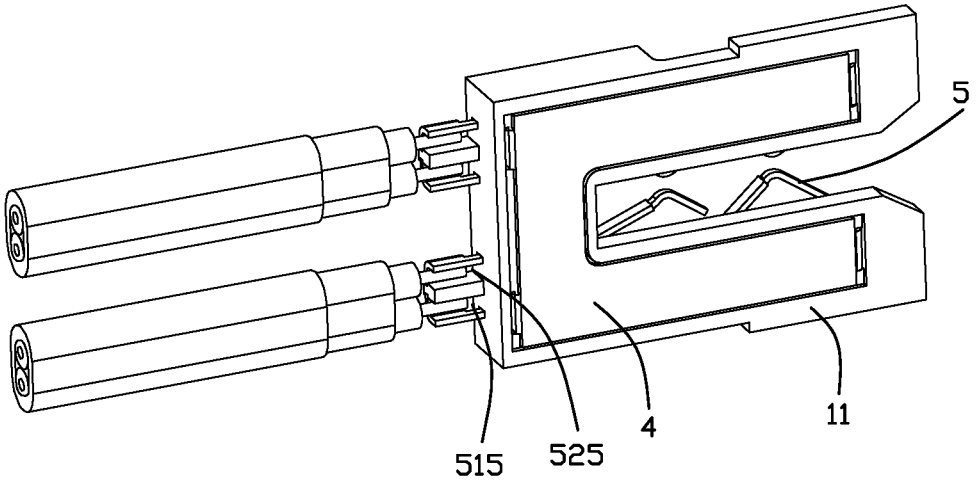
FIG. 3 is a perspective view of a contact wafer shown in FIG. 2.
Figure 4:
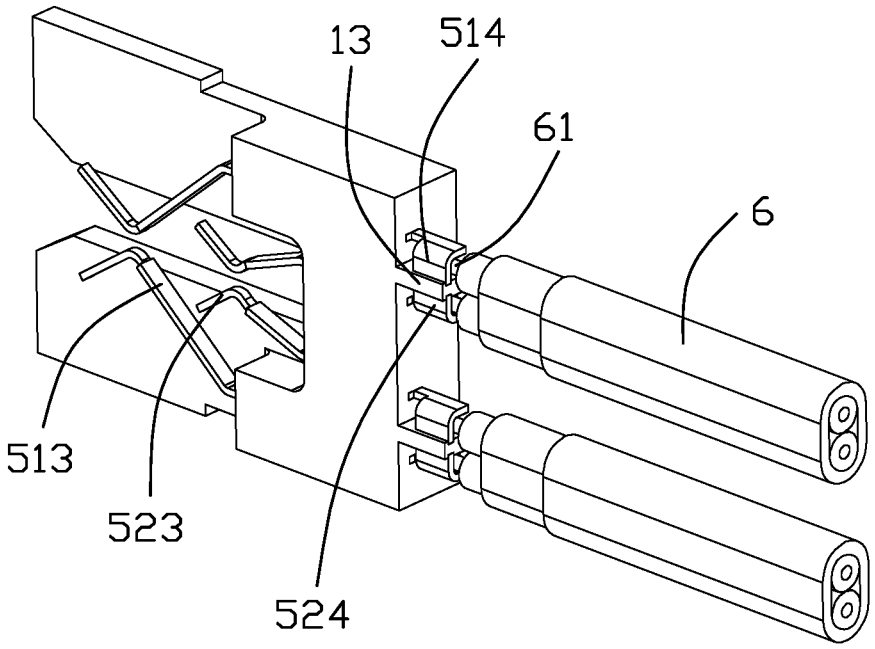
FIG. 4 is another perspective view of the contact wafer shown in FIG. 3.
Figure 5:
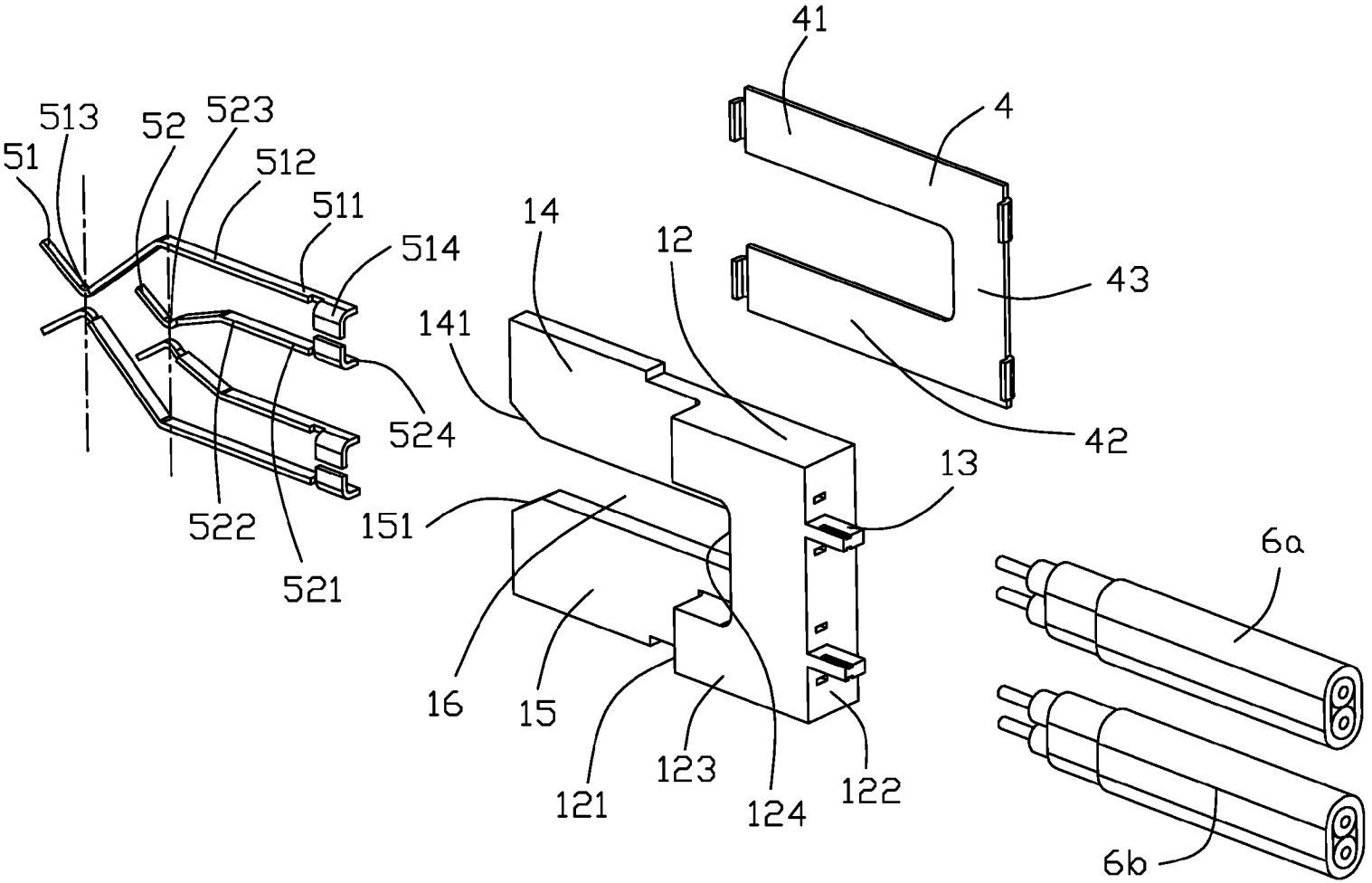
FIG. 5 is an exploded perspective view of the contact wafer shown in FIG. 4.

Referring to FIGS. 3 to 5, the insulative housing 11 includes a main body portion 12, a pair of extending portions 14, 15 extending forwardly therefrom and two protruding portions or dividers 13 extending backwardly. The main body portion 12 includes a front face 121, a rear face 122 opposite to the front face 121 and two side faces 123 connecting the front face 121 and the rear face 122. The main body portion 12 further forms a step structure (not labeled) with two forward faces, i.e., the front face 121 and an intermediate face 124 located between the front face 121 and the rear face 122 in the front-to-back direction. The protruding portions 13 extend backwardly from the rear face 122 of the main body portion 12. The pair of extending portions 14, 15 includes an upper extending portion 14 and a lower extending portion 15. The upper extending portion 14 extends forwardly from a top portion of the main body portion 12. The lower extending portion 15 extends forwardly from a bottom portion of the main body portion 12. The upper and lower extending portions 14, 15 form an insertion opening 16 therebetween. The insertion openings 16 of the contact wafers 1 are arranged transversely to form the mating cavity 101 to retain the card edge 210 of the Central Processing Unit 200. The main body portion 12 is thicker than the extending portions 14, 15 along the transverse direction. Each of the terminals 5 includes a contacting section 513, 523 extending forwardly from the main body portion 12 and spaced from the extending portion 14, 15 along the transverse direction. The shielding plate 4 is retained in a lateral side of the extending portions 14, 15, and the terminals 5 are retained in the other lateral side of the extending portion which is opposite to the shielding plate 4 along the transverse direction.

The terminals 5 include a plurality of upper terminals located at a lateral side of the upper extending portion 14 and a plurality of lower terminals located at the lateral side of the lower extending portion 15. The upper terminals and the lower terminals are symmetrically arranged along a vertical direction perpendicular to both of the front-to-back direction and the transverse direction. The electrical connector 100 includes a plurality of cables 6 with a plurality of upper differential pair cables **6*a* connected to the upper terminals and a plurality of lower differential pair cables 6***b* connected to the lower terminals, respectively. The upper terminals of each contact wafer 1 include a first terminal 51 and a second terminal 52. The first terminal 51 includes a first holding section 511 retained in the main body portion 12, a first extending section 512 extending forwardly from the first holding section 511, a first contacting section 513 extending forwardly from the first extending section 512 and protruding downwardly into the insertion opening 16, and a first soldering section 514 extending backwardly beyond of the main body portion 12. The second terminal 52 includes a second holding section 521 retained in the main body portion 12, a second extending section 522 extending forwardly from the second holding section 521, a second contacting section 523 extending forwardly from the second extending section 522 and protruding downwardly into the insertion opening 16, and a second soldering section 524 extending backwardly beyond of the main body portion 12. The first contacting section 513 is located in front of the connecting section 523 of the second terminal 52. The protruding portion 13 is disposed between the first and second soldering sections 514, 524 to separate the first and second soldering sections 514, 524 along the vertical direction. Each of the soldering sections 514, 524 cooperates with the protruding portion 13 to form a receiving slot 515, 525 to retain a head of a cable 6 and avoid short circuit therebetween when welding the cable 6 to the soldering sections 514, 524.

The shielding plate 4 is retained in a lateral side of the insulative housing 11 to reduce the crosstalk of two neighbored contact wafers 1. The shielding plate 4 includes an upper plate 41 mounted to the upper extending portion 14, a lower plate 42 mounted to the lower extending portion 15 and a connecting portion 43 mounted to the main body portion 12.

The insulative plates 2 are assembled at two opposite sides of the contact wafers 1 to separate the contact wafers 1 from the metal shell 3 along the transverse direction. A guiding cavity is defined by lead-in tapered faces 21, 141, 151 of the insulative plate 2 and is wider than the insertion opening 16 along the vertical direction so as to insert the card edge 210 of the Central Processing Unit 200 therein easily.

A method of assembling the electrical connector 100 including following processes: firstly, assembling the contact wafers 1 together along the transverse direction; secondly, assembling two insulative plates 2 at two opposite sides of the contact wafers 1; thirdly, assembling the metal shell 3 to surround the contact wafers 1 and the insulative plates 2. The length of the contact wafers 1 is changeable when necessary so as to make the electrical connector suitable for different complementary connectors.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. An electrical connector comprising:

a metal shell defining a receiving cavity extending along a front-to-back direction; and a plurality of contact wafers retained in the receiving cavity and assembled together along a transverse direction perpendicular to the front-to-back diction, the contact wafers defining a mating cavity extending along the transverse direction and the front-to-back direction, each of the contact wafers comprising:

an insulative housing comprising a main body portion and a pair of extending portions extending forwardly therefrom, the pair of extending portions forming an insertion opening therebetween; and a plurality of terminals retained in the insulative housing;

wherein the main body portion is thicker than the extending portions along the transverse direction, and each of terminals has a contacting portion extending forwardly from the main body portion and spaced from the extending portion along the transverse direction.

2. The electrical connector as claimed in claim 1, wherein the pair of extending portions comprise an upper extending portion and a lower extending portion, each contact wafer comprises a plurality of upper terminals and a plurality of lower terminals respectively spaced from the upper and lower extending portion, and the upper terminals and the lower terminals are symmetrically arranged along a vertical direction perpendicular to both of the front-to-back direction and the transverse direction.

3. The electrical connector as claimed in claim 2, wherein the contacting sections of the upper terminals extend downwardly into the mating cavity, and the contacting sections of the lower terminals extend upwardly into the mating cavity.

4. The electrical connector as claimed in claim 2, wherein each of the contact wafers comprises a shielding plate retained at a lateral side of the insulative housing which is opposite to the contacting sections of the terminals along the transverse direction.

5. The electrical connector as claimed in claim 4, wherein the shielding plate comprises an upper plate mounted to the upper extending portion, a lower plate mounted to the lower extending portion and a connecting portion mounted to the main body portion.

6. The electrical connector as claimed in claim 2, wherein each of the upper and lower extending portions comprises a lead-in tapered face to form a guiding cavity therebetween for easily insertion of a complementary connector, and the dimension of guiding cavity is larger than the dimension of the insertion opening along the vertical direction.

7. The electrical connector as claimed in claim 2, wherein the upper terminals of each contact wafer comprise a first terminal having a first soldering section extending backwardly beyond of the main body portion and a second terminal having a second soldering section extending backwardly beyond of the main body portion, and the insulative housing also comprises a protruding portion extending backwardly from the main body portion to separate the first and second soldering sections along the vertical direction.

8. The electrical connector as claimed in claim 7, wherein each soldering section cooperates with the protruding portion to form a receiving slot to receive a head of a cable.

9. The electrical connector as claimed in claim 7, wherein said contacting section of the first terminal is located in front of the contacting section of the second terminal.

10. The electrical connector as claimed in claim 1, further comprising two insulative plates assembled at two opposite sides of the contact wafers to separate the contact wafers from the metal shell along the transverse direction.

11. An electrical connector comprising:

a plurality of contact wafers side by side stacked with one another along a transverse direction, each of said contact wafers including:

an insulative housing with a lying U-shaped configuration viewed along said transverse direction so as to form a receiving slot in said U-shaped configuration;

a pair of upper contacts and a pair of lower contact disposed in the housing and space from each other and on two sides of the receiving slot in a vertical direction perpendicular to said transverse direction, the pair of upper contacts being spaced from each other in the vertical direction with a contacting end of one upper contact located in front of that of the other upper contact, the pair of lower contacts being spaced from each other in the vertical direction with a contacting end of one lower contact located in front of that of the other lower contact, wherein the contacting end of said one upper contact is aligned with the contacting end of said one lower contact in the vertical direction, and the contacting end of the said other upper contact is aligned with the contacting end of said other lower contact; and an upper differential pair cable connected to the pair of upper contacts, a lower differential pair cable connected to the pair of lower contacts, respectively.

12. The electrical connector as claimed in claim 11, wherein each housing includes a main body portion with an upper extending portion and a lower extending portion extending forwardly to commonly form said U-shaped configuration, and said main body portion is thicker than the upper extending portion and said lower extending portion in said transverse direction.

13. The electrical connector as claimed in claim 12, wherein each of said contact wafers includes a U-shaped shielding plate complying with said U-shaped configuration and attached to the housing and spaced from the contacts by the corresponding upper extending portion and lower extending portion.

14. The electrical connector as claimed in claim 11, wherein each of said pair of upper contacts forms a tail section exposed outside of the housing, and a divider unitarily extending rearwardly form a rear side of the housing is formed between said tail sections of the pair of upper contacts, and the tail section forms an L-shaped configuration to cooperate with said divider to form a U-shaped slot in which a wire is adapted to be protectively soldered to the tail section.

15. The electrical connector as claimed in claim 11, wherein main body portion forms a step structure with two different forward faces, and the pair of upper contacts extend out of the main body portion from said two different forward faces, respectively.

* * * * *